US008667658B2

(12) United States Patent
Kalbfuss

(10) Patent No.: US 8,667,658 B2
(45) Date of Patent: Mar. 11, 2014

(54) CALIBRATION METHOD IN A MACHINE FOR PROCESSING PLATE ELEMENTS

(75) Inventor: Jean-Michel Kalbfuss, Dommartin (CH)

(73) Assignee: BOBST MEX SA (CH)

( * ) Notice: Subject to any disclaimer, the term of this patent is extended or adjusted under 35 U.S.C. 154(b) by 415 days.

(21) Appl. No.: 13/132,962

(22) PCT Filed: Nov. 20, 2009

(86) PCT No.: PCT/EP2009/008284
§ 371 (c)(1),
(2), (4) Date: Jun. 6, 2011

(87) PCT Pub. No.: WO2010/063380
PCT Pub. Date: Jun. 10, 2010

(65) Prior Publication Data

US 2011/0239432 A1 Oct. 6, 2011

(30) Foreign Application Priority Data

Dec. 5, 2008 (EP) ..... 08021168

(51) Int. Cl.
*B23Q 17/00* (2006.01)
*B23P 19/00* (2006.01)

(52) U.S. Cl.
USPC ..... 29/407.01; 29/650

(58) Field of Classification Search
USPC ..... 29/407.01, 650, 407.04, 407.09; 358/406, 504; 399/371
See application file for complete search history.

(56) References Cited

U.S. PATENT DOCUMENTS

| | | | | |
|---|---|---|---|---|
| 5,705,020 | A | 1/1998 | Chiari | |
| 6,378,862 | B1 | 4/2002 | Rebeaud | |
| 6,566,670 | B1 | 5/2003 | Buisker et al. | |
| 7,202,492 | B2 | 4/2007 | Inhelder et al. | |
| 7,391,525 | B2 * | 6/2008 | Chapman et al. | 358/1.12 |

FOREIGN PATENT DOCUMENTS

| | | | |
|---|---|---|---|
| CH | 690470 | A5 | 9/2000 |
| EP | 1044908 | A | 10/2000 |
| EP | 1623943 | A | 2/2006 |

OTHER PUBLICATIONS

International Search Report dated Mar. 9, 2010, issued in corresponding international application No. PCT/EP2009/008284.

* cited by examiner

*Primary Examiner* — John C Hong
(74) *Attorney, Agent, or Firm* — Ostrolenk Faber LLP

(57) ABSTRACT

A calibration method and machine for detecting a location mark (12) printed on plate elements (10) within a processing machine (1) having an introducer (20) for positioning the plate elements (10) into a plurality of gripping members (31) of a conveyor (30) which conveys them in rhythmical motion into successive stations (3, 4, 5). The introducer (20) includes a fastening device to the plate elements. The introducer (20) is driven by a control unit (40) that also drives at least one illuminating device and at least one sensor (7). A plate element (10) is selected from a batch of them. The fastening device fixes the plate element (10) to the introducer (20). The introducer (20) is driven to perform a succession of back-and-forth movements with the plate element (10). At the time of each back-and-forth movement, the illumination device subjects the location mark (12) printed on the plate element (10) to a different illumination, and the sensor (7) performs a corresponding measurement, so as to obtain a succession of measurements. The calibrated illumination parameters that will be used during the processing of the whole batch of plate elements (10) are determined according to the succession of measurements obtained.

14 Claims, 4 Drawing Sheets

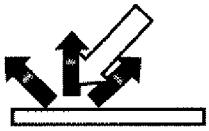
Fig. 5a
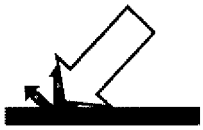
Fig. 5b
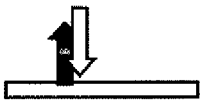
Fig. 5c
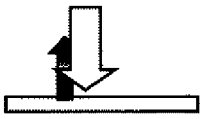
Fig. 5d
Fig. 5

CALIBRATION METHOD IN A MACHINE FOR PROCESSING PLATE ELEMENTS

CROSS-REFERENCE TO RELATED APPLICATIONS

The present application is a 35 U.S.C. §§371 national phase conversion of PCT/EP2009/008284, filed Nov. 20, 2009, which claims priority of European Application No. 08021168.3, filed Dec. 5, 2008, the contents of which are incorporated by reference herein. The PCT International Application was published in the French language.

BACKGROUND OF THE INVENTION

The subject of the present invention is a calibration method in a machine for processing plate elements, and a machine for processing plate elements using said method.

Such machines are used in particular in the printing and packaging industry, for example for the manufacture of cardboard boxes from plate elements such as sheets of preprinted cardboard. In an introduction station, these sheets are taken from a stack situated upstream of the machine, and are then positioned by an introducer in gripper bars mounted at regular intervals on a subsequent line of endless chains. The latter makes it possible to convey the sheets into the various later processing stations of the machine. Typically, such stations are devoted to cutting the sheets, ejecting the cutting waste and receiving these sheets in a stack.

In a rhythmical motion, the line of chains moves and stops periodically so that, during each movement, all the gripper bars engaged with a sheet are passed from one station to the adjacent station downstream. If it is desired to obtain a print or a quality conversion, the positioning of the sheets within the various successive stations is a fundamental operation. For the cutting of a printed sheet, it will be understood that the positioning of the sheet in the cutting station must be precise. Specifically, it is appropriate to ensure that the tools used for cutting, for example the form to be cut of a platen press, are in perfect register with the print that has previously been made on the sheet.

Patent CH 690,470 describes a device for ensuring the quality of production of a press for making packages. To do this, this device comprises a camera designed to read on the one hand location marks associated with the printing, and on the other hand a mark intended for locating the cutting position. These location marks are placed on the front spoil of the sheet held by the gripper bar. The cutting mark is made by means of a perforator secured to the cutting tools. This perforator arranges a hole in the front spoil of the sheet at the same time as the latter is cut. Further downstream, another device makes it possible to mark the sheets identified as being faulty by the camera, namely those which have an out-of-tolerance offset between the printing and the cutting.

Patent EP 1,044,908 relates to a device and a method for positioning plate elements in an introduction station. From a bed situated in a rear starting position, this method consists in engaging means for fastening a plate element to the bed, then in commanding actuators to allow its movement forward depending on the position of the plate element on the bed. Accordingly, the front edge of the plate element is brought forward, stopped and then released in a predetermined position in the grippers of the gripper bar of the conveyor device before the bed has been finally returned to the start position. In order to be able to move the bed forward, if necessary sideways or obliquely, by an adequate amount, optoelectronic means read the coordinates of the position of the plate element and calculate the movement necessary to be able to position it as correctly as possible in the gripper bar.

The processing of a batch of identical plate elements, that is to say of the same dimensions, consisting of the same material and bearing the same prints is called a job. When the operator carries out a new job on the machine, he begins by calibrating the sensors which are used to detect the various location marks printed on the plate elements. This operation requires operator expertise, takes time and consumes plate elements in order to carry out the various tests until an acceptable result is obtained.

SUMMARY OF THE INVENTION

The object of the present invention is to remedy the aforementioned disadvantages so as to reduce the time for starting new jobs, the consumption of plate elements during start-up and to improve the quality obtained.

Accordingly, the subject of the present invention is a calibration method in a processing machine and a machine for processing plate elements using this method.

The invention will be better understood on studying embodiments taken in a manner that is in no way limiting and illustrated by the appended figures in which.

FIGS. 5*a, b, c* and *d* each illustrate the illumination of a plate element and reflection of light from a plate element which is illuminated directly or indirectly and at greater or lesser intensity of illumination.

DESCRIPTION OF PREFRERRED EMBODIMENTS

In order to prevent any confusion in the following description, the terms "upstream" and "downstream" will be defined with reference to the direction of movement of the plate elements, as illustrated by the arrow D in FIG. 2. These elements move from upstream to downstream, usually following the main axis X of the machine, in a movement given rhythm by periodic stops. Also it is specified that the adjectives "longitudinal" and "lateral" are defined relative to this main axis X. The terms "plate elements" and "sheets" will be considered equivalent and will relate to both elements made of corrugated cardboard and flat cardboard or any other material routinely used in the packaging industry.

Figure 1:
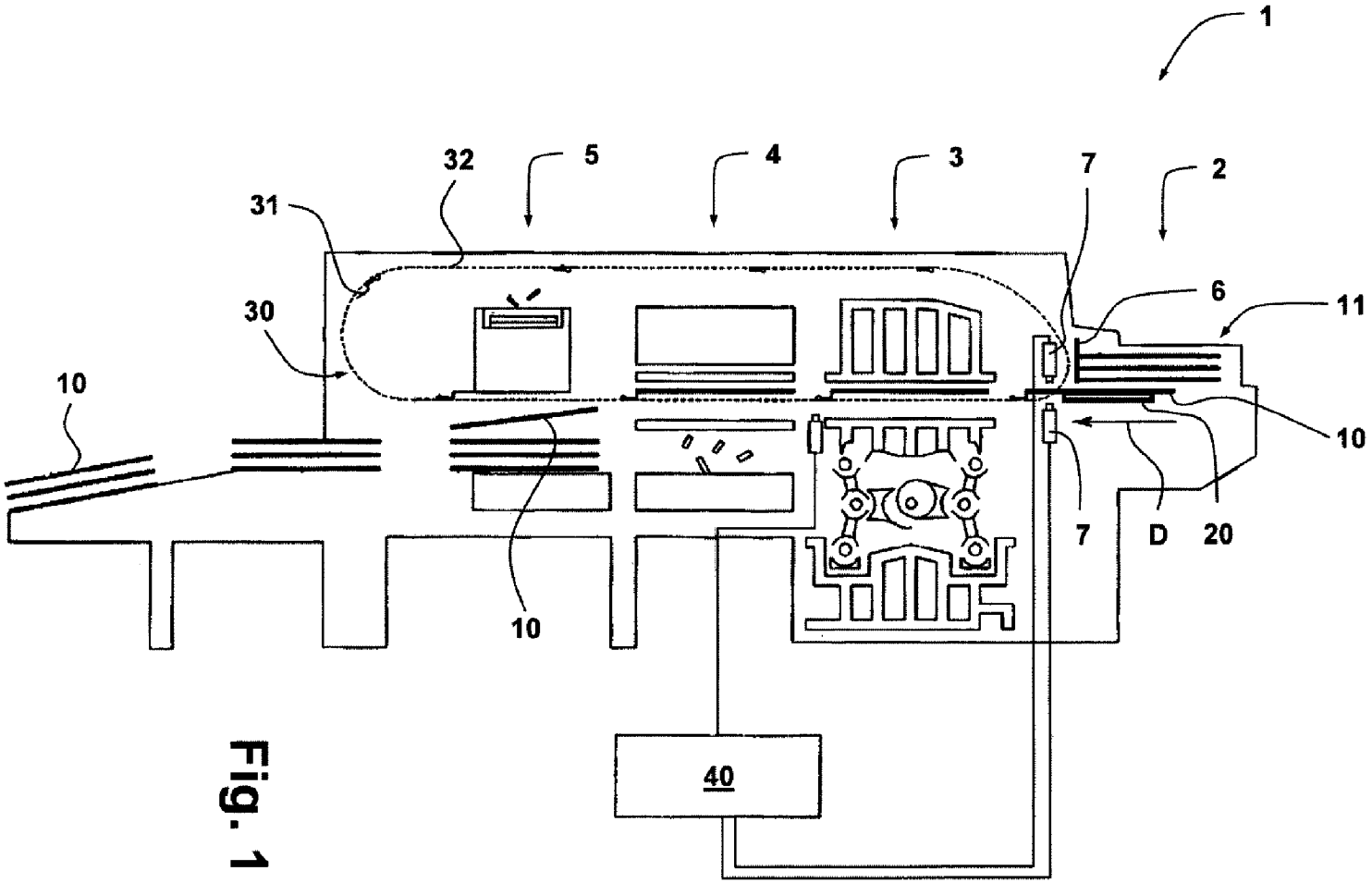
FIG. 1 is a schematic representation of a first type of processing machine in which plate elements travel conveyed by gripper bars.

FIG. 1 shows a schematic overview of a processing machine 1 in which the method of the present invention may be applied. This machine comprises a series of processing stations, amongst which are typically an introduction station 2 followed by a cutting station 3, a spoil ejection station 4 and a reception station 5. The number and type of processing stations may vary depending upon the complexity of the conversion operations to be carried out on plate elements 10.

In the introduction station 2, these plate elements are placed in a stack 11, which rests notably against a gauge 6 also serving as a front stop for these elements. Thanks to the gap left at the bottom of the gauge 6, these elements may be taken one by one from the bottom of a stack 11 by means of an introducer 20. This device will make it possible to introduce each of them into a gripping member 31 of a conveyor 30, as can be better seen in FIG. 2. This conveyor usually consists of a line of chains 32, between the chains of which are arranged a plurality of gripper bars, each serving as a gripping member 30 for the plate element 10.

The line of chains 32 moves and stops periodically so that, during a movement, each gripping member 31 is passed from one station to the adjacent downstream station. The position of the stops for the gripping members is dictated by a constant-distance movement of the line of chains. This distance corresponds to the theoretical pitch of these members on the line of chains. The processing stations 2, 3, 4 and 5 are fixed and set apart at this same pitch so that, at each stop, the gripping members 31 are stopped in register with the tools of these stations. Such a type of machine is most frequently used to process corrugated cardboard plate elements.

Figure 2:
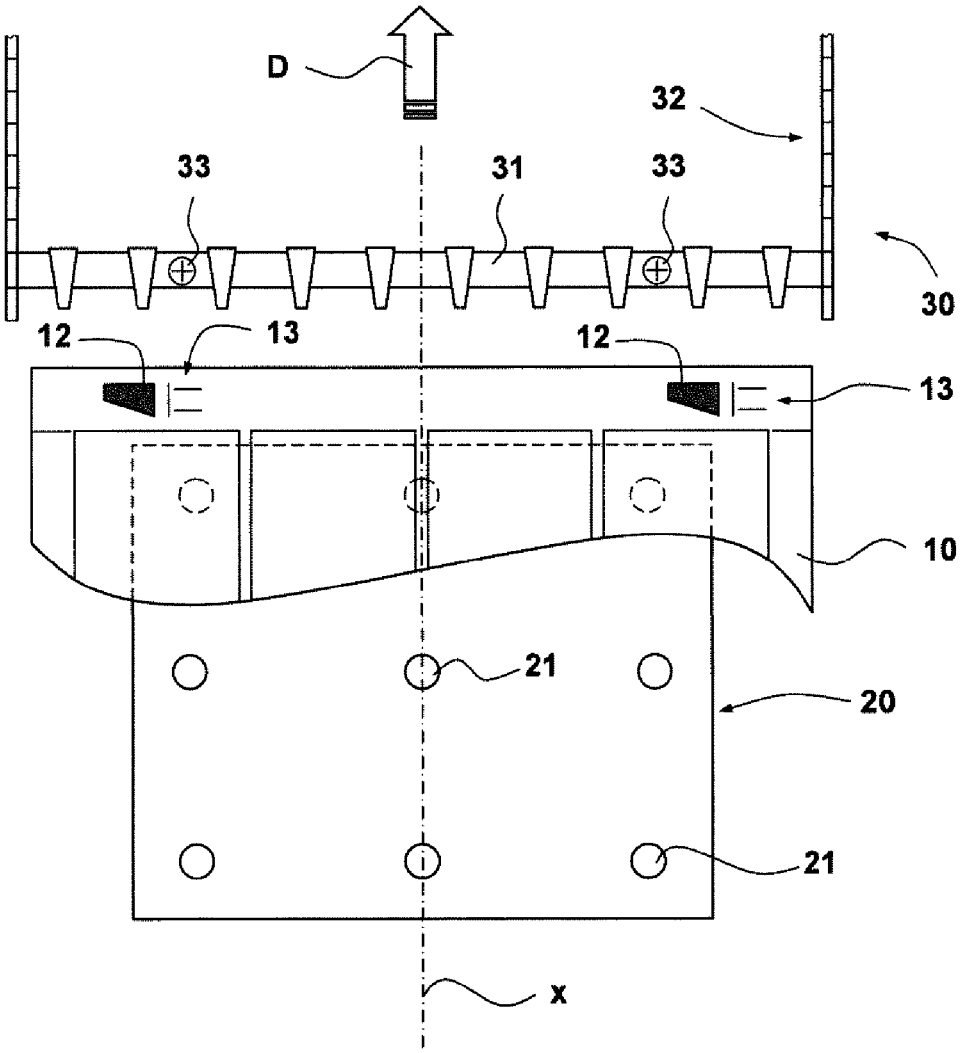
FIG. 2 is a schematic plan view of the front edge of a plate element moving in the direction of a gripper bar in order to be held by the latter.

FIG. 2 represents, in a schematic top view, a downstream portion of a plate element 10 moving toward a gripper bar via the introducer 20. In the example of a processing machine shown in FIG. 2, the introducer 20 is furnished with a fastening device 21 consisting of a plate with suckers. This fastening device 21 makes it possible to suck the plate element from the bottom of the stack 11 and thereby to secure it to the introducer 20, which will slide the plate element 10 beneath the gauge 6 and bring it into a determined position in engagement with the grippers of the gripping member 31. The trajectory of the introducer 20 depends on the initial position of the plate element 10 at the bottom of the stack. This position is measured by first sensors 7, situated directly downstream of the gauge 6 (FIG. 1). Preferably, one pair of these sensors will be placed above the plane of passage of the plate elements and another beneath. Thanks to this arrangement, it becomes possible to read printed marks 12 (FIG. 2) making it possible to locate a print made either on the face side or on the reverse side of the plate element. Such location marks 12 are usually placed on its front portion, namely on the front spoil useful for the holding of the plate element by the gripping member, but may also be placed on the side portion of the plate element 10, particularly in order to measure the lateral position of the plate element, in order to carry out a lateral alignment. The sensors 7 measure the intensity of the light reflected by the surface of the plate element 10 when it is illuminated by an illumination device, in a predetermined zone containing the location marks. A processing of the signal obtained then makes it possible to calculate the position of the location mark. For reasons of space requirement, the illumination device is sometimes incorporated into the sensor 7 but that is not a necessity. In the exemplary embodiment of FIG. 2, the sensors 7 contain the illumination devices.

As soon as the measurements have been taken by said first sensors 7, these measurements are immediately transmitted to a control unit 40 to calculate the position of the location marks and the trajectory of the introducer 20. Knowing the theoretical stopping position of the gripping member 31 in the introduction station, the control unit is capable of calculating the values of the movement parameters (lateral, longitudinal or slantwise) of the introducer 20, so that the latter correctly brings the plate element that it conveys into the gripping member, depending on its initial starting position. These calculations are made by the control unit 40 which also drives the introducer 20.

The plate element 10 will then be conveyed by the gripping member 31 into the cutting station 3, where it will be cut according to a matrix corresponding to the developed shape that it is desired to obtain, for example for the purpose of obtaining a plurality of boxes of a given shape. In this station, or in one or more subsequent stations, other operations may also be carried out such as the scoring of fold lines, the stamping of certain surfaces and/or the placement of patterns from metalized strips for example.

Figure 3:
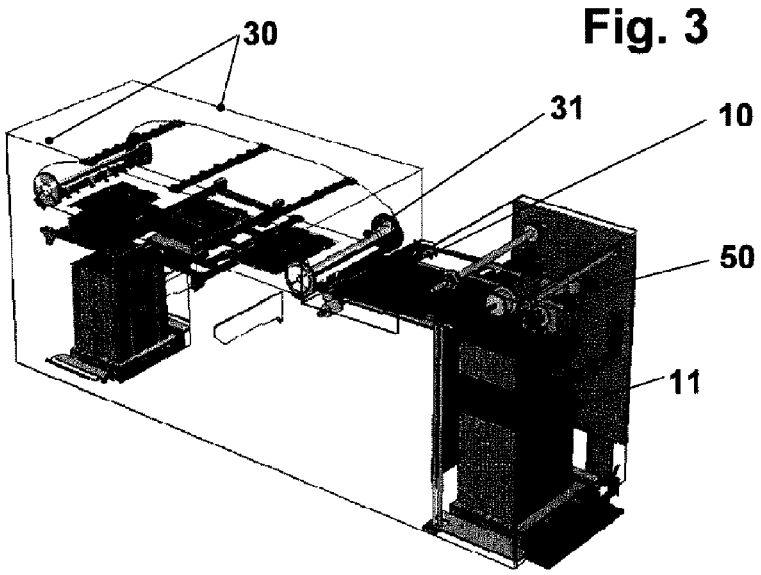
FIGS. 3 and 4 are schematic representations of a second type of processing machine in which plate elements travel conveyed by gripper bars.

FIG. 3 represents another example of a punch press known hitherto in which the plate elements 10 to be worked are sheets taken from the top of a stack 11, placed in the form of an overlapping stream and then conveyed on a feed board before being introduced into the grippers 31 of the conveyor members 30 of the cutting station of the press. Thus, document EP1170228 describes an example of a sheet-by-sheet feeding device for the creation of the overlapping stream; and document EP0680906 describes an example of a conveying member of the cutting station of the press, using gripper bars.

Figure 4:
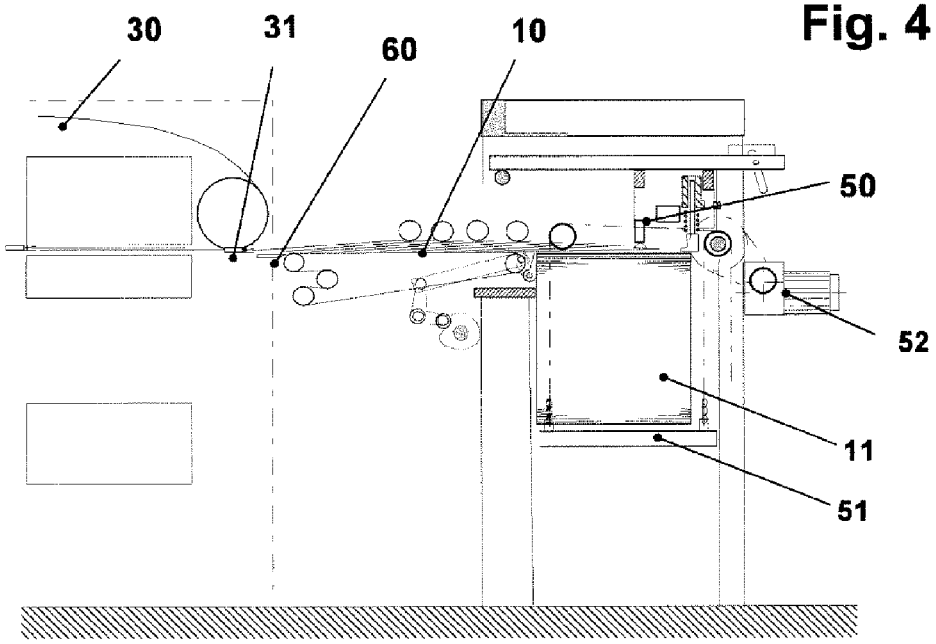

The devices for creating the overlapping stream of sheets and for conveying the overlapping stream are shown in greater detail in FIG. 4. The stack 11 is fed in an overlapping stream by the sucker group 50, the top of the stack 11 being maintained at a constant level thanks to the raising of the stack-supporting tray 51 driven by a motor 52. The sheet on the top of the stack 11 is picked up from the rear and then pushed forward by the sucker group 50 so as to form the overlapping stream, the front portion of the sheet 10 sliding beneath the previous sheet.

The sheets of the overlapping stream are precisely positioned longitudinally and laterally by a positioning device 60 which has an operation that is similar to that of the introducer 20 of the processing machine shown in FIGS. 1 and 2. Document EP 1044908 describes an example of a sheet positioning device by which the overlapping stream 3 is formed. As described in this document, the positioning takes place at the end of the feed board closest to the conveyor members 5 of the cutting station, by using a sophisticated system which does not require the sheets to stop. The positioning device 60 comprises a shelf furnished with a fastening device comprising grippers, the function of which, identical to that of the suction plate 21 of the introducer 20 shown in FIG. 2, is to fasten a plate element 10 to the shelf, in order to convey it into the gripping member 31, depending on its initial starting position in a manner similar to that described above. In this way sensors measure the reflected light intensity, which makes it possible to calculate the position of the location marks and the movement that the shelf of the positioning device must make in order to correctly place the downstream edge of the plate element in the gripping member 31. This type of press is most frequently used when the plate elements 10 are sheets of flat cardboard.

Many types of plate materials, having very different characteristics, are used in the packaging industry. For example, the surface of certain materials may be very reflective, while other materials will be transparent. The shades of the materials may vary from white to matt black, and the increasingly elaborate prints are placed on their surfaces. Whatever the type of material of the plate element 10 and the print that it bears, the detection of the location marks 12 must be perfect, so that the processes carried out by the machine are in register with the prints present on the plate element 10.

The object of the present invention is therefore to ensure optimal detection of the location marks 12 printed on the plate materials, while reducing the time for starting a new job and the quantity of spoil produced during this startup, by proposing a calibration method within a machine for processing plate elements which will be used when the machine is started up for a new job and a machine for processing plate elements capable of applying this calibration method. In the detailed description that follows of exemplary embodiments of the invention, the term "introducer" will be used to designate a device the function of which is to introduce the downstream edge of a plate element 10 into the gripping member 31. Such a device corresponds to the introducer 20 shown in FIGS. 1 and 2, or to the positioning device 60 shown in FIG. 3 and detailed in document EP1044908. The introducer is furnished with a fastening device which makes it possible to secure the plate element 10 to the introducer. The above examples have shown that the fastening device could take different forms, such as that of a suction plate 21 shown in FIG. 2, or else that of grippers.

For the rest of the description, the terminology and numbering of the elements will be those of FIGS. 1 and 2. Only the calibration for detecting a location mark will be described, it being understood that if several location marks are printed, the method is carried out for each of the location marks, simultaneously or in succession. "Mark" is understood to be any surface treatment applied for the purpose of obtaining a clear change in reflected light intensity.

During a first step of the method that is the subject of the invention, the fastening device 21 takes hold of a plate element 10 in order to secure it to the introducer 20. The way in which this plate element 10 is selected from the batch which has to be processed is of no importance: the selection may be automatic from a stack of plate elements, or else manual.

In a second step of the method, the control unit 40 impresses on the introducer 20 a back-and-forth movement, while the plate element 10 selected during the previous step is secured to the introducer 20 by the fastening device 21.

Simultaneously, the control unit 40 drives the illumination device and the sensor 7 so that the region of the plate element bearing the location mark 12 is illuminated by the illumination device, with a different illumination for each back-and-forth movement made by the introducer 20; and in order that the reflected light intensity is measured by the sensor 7. The measurements taken by the sensor 7 are transmitted to the control unit 40 of the machine, and thereby form a succession of measurements which corresponds to the succession of back-and-forth movements made by the introducer 20.

In a final step, the control unit 40 determines, on the basis of the succession of measurements obtained during the previous step, the illumination parameters which will be used for the whole batch of plate elements, that is to say for the job in question. This determination applies conventional techniques of processing the signal, which make it possible to analyze the quality of detection for each measurement made by the sensor 7, and therefore for each corresponding illumination.

According to a preferred embodiment of the invention, one of the illumination parameters relates to the selection between a direct illumination and an indirect illumination. An illumination is considered to be direct when it is substantially perpendicular to the surface of the plate element, and to be indirect when it has an angle of incidence with the surface.

FIG. 5 represents various examples of illumination. The white arrows indicate the direction of the illumination light toward a plate element, the black arrows indicate the direction of reflection of light from the plate element and the thickness of the arrows indicate light intensity. Therefore, an indirect illumination of average intensity referenced 5*a* is particularly suitable for jobs concerning plate elements the surfaces of which are diffusing and light, which is usually the case. Nevertheless an indirect illumination of high intensity referenced 5*b* is particularly suitable for a dark diffusing surface, a direct illumination of low intensity referenced 5*c* is particularly suitable for plate elements consisting of a material the surface of which is reflective, and a direct illumination of high intensity referenced 5*d* is particularly suitable for a transparent material. The method according to the invention therefore provides an excellent quality of detection of the location marks irrespective of the type of material.

A plurality of measurements may optionally be taken for each type of illumination, direct or indirect, with various levels of light intensity.

Advantageously, for one and the same type of illumination, distinct reflected colors are measured during various back-and-forth movements, so as to adapt the illumination not only to the characteristics of the material of the plate element but also to those of the prints carried by its surface. This embodiment may, for example, consist in using a plurality of sensors 7, each measuring the reflected light intensity in a different spectrum, typically red, green and blue. The illumination parameters then comprise one light intensity parameter for each of the sources.

In a preferred embodiment, several light sources of different colors are used for each type of illumination, direct or indirect. In order to limit the number of back-and-forth movements made by the introducer 20, the type of material of which the plate element 10 is composed may be optionally indicated by the operator of the machine, so as to directly determine the type of illumination used by the illumination device 7 and an order of magnitude of the light intensity, as, for example, shown in FIG. 5.

Once this calibration process has been carried out, the illumination parameters determined will be used throughout the job in question. The method according to the invention makes it possible to obtain in an extremely rapid manner an excellent quality of detection of the location marks, irrespective of the type of material forming the plate elements and the prints that they bear, reducing to the minimum the consumption of plate material.

A plate processing machine according to the invention will therefore comprise in a conventional manner an introducer 20 furnished with a fastening device 21. The introducer 20 makes it possible to position these plate elements 10 in a plurality of gripping members 31 of a conveyor 30, which conveys them in a rhythmical motion into successive stations. Also in a conventional manner, a processing machine according to the invention will comprise at least one LED illumination device placed so as to illuminate a location mark 12 printed on a plate element 10 when the latter is secured to the introducer 20 by the fastening device 21; and at least one sensor 7 which measures the light intensity reflected by the surface of the plate element when it is illuminated by the illumination device. The processing machine according to the invention also comprises a control unit 40, of the microprocessor or microcontroller type, which drives the introducer 20, the illumination device and the sensor 7 and which receives the measurements taken by the sensor 7.

According to the invention, the illumination device is of the type that is capable of generating various illuminations, that is to say that it is capable of generating one illumination selected from a set of possible illuminations, depending upon the illumination parameters that are transmitted to it. The introducer 20 is capable of carrying out a back-and-forth movement when a plate element is held by the fastening device. During calibration for a new job, the control unit 40 drives the introducer 20, the illumination device and the sensor 7 so that the introducer 20 makes a succession of back-and-forth movements, while a plate element 10 is held by the fastening device 21. Therefore, the location mark 12 printed on the surface of the plate element 10 is subjected to an illumination during each back-and-forth movement, and the sensor 7 measures, for each back-and-forth movement, the reflected light intensity. The control unit 40 receives the measurements taken by the sensor 7, which form a succession of measurements corresponding to the succession of back-and-forth movements made by the introducer 20.

According to the invention, the control unit 40 drives the illumination device so that a different illumination is applied to the surface of the plate element 10 during each back-and-forth movement made by the introducer 20 during calibration. Then the control unit 40, based on the succession of measurements made by the sensor 7, determines the illumination parameters which will be used for the job, that is to say for the processing of all the plate elements 10 forming the batch.

Advantageously, the illumination device makes it possible to carry out a direct illumination, that is to say in a direction substantially perpendicular to the surface of the plate element 10 conveyed by the introducer 20, and an indirect illumination, that is to say in a direction having an angle of incidence with the surface of the plate material, and the control unit 40 drives the illumination device while checking which type of illumination is used: direct or indirect. The illumination device may optionally comprise a distinct light source for each type of illumination, direct or indirect.

Preferably, the illumination device makes it possible to illuminate in various colors; for example, by comprising a plurality of light sources of different colors. The control unit 40 may advantageously drive the illumination device while determining the light intensity of each source of color.

The surface of the plate elements 10 most frequently bears a plurality of location marks 12. The processing machine then has illumination devices and the sensors 7 for each location mark. These illumination devices and these sensors 7 may be identical for all the marks. However, in order to propose a greater capability for correcting the error in lateral positioning of the plate elements 10, it is possible optionally to use different illumination devices and sensors 7 for the location mark or marks 12 designed to achieve the lateral alignment of the plate element 10 than for the location mark or marks 12 present on the downstream edge of the plate element 10. For example, for the detection and measurement of the position of the location marks printed on the downstream edge of the plate element 10, it is possible advantageously to use an illumination device comprising one or more light sources for a direct illumination and one or more light sources for an indirect illumination with a sensor 7; and for the detection and measurement of the position of the lateral location marks of the plate element 10, it is possible advantageously to use a multiple-color illumination device, for example, red, green and blue, with a sensor 7 in the form of a bar, consisting, for example of 32 to 512 monochrome cells, making it possible to measure the reflected light intensity over a straight line segment.

Preferably, the illumination device is incorporated into the casing of the corresponding sensor 7, which procures many advantages in terms of space requirement, ease of installation and mechanical adjustment, but also in terms of maintenance.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

The invention claimed is:

1. A calibration method for detecting a location mark printed on plate elements within a processing machine, wherein the machine comprises a successive series of operating stations through which the plate elements are to be conveyed, a conveyor configured and operable for conveying the plate elements through the stations, and gripping members on the conveyor for gripping the plate elements;

an introducer configured and operable for positioning the plate elements into a plurality of the gripping members of the conveyor and the conveyor being configured and operable to convey the plate elements in rhythmical motion into the successive stations, the introducer including a fastening device configured and operable for fastening the plate elements temporarily to the introducer;

a control unit driving motion of and temporarily attaching of the plate elements to the introducer;

at least one illuminating device and at least one sensor illuminated by the illuminating device, the control unit controlling the illuminating device and the sensor;

the method comprising:

selecting a plate element from a batch of the plate elements to be processed, activating the fastening device to fix the selected plate element to the introducer, driving the introducer to perform a succession of back-and-forth movements with the plate element fixed to the introducer, also driving the illumination device and the sensor so that, at the time of each back-and-forth movement of the introducer:

the illumination device subjects a location mark printed on the plate element to a different illumination, the sensor performs a corresponding measurement to each different illumination, so as to obtain a succession of measurements, according to the succession of measurements obtained, determining calibrated illumination parameters to be used during processing of a batch of the plate elements.

2. The method according to claim 1, wherein one of the calibrated illumination parameters is a respective direct or indirect character of the illumination of the plate element.

3. The method according to claim 2, wherein one of the calibrated illumination parameters is a color of the respective illumination.

4. The method according to claim 3, wherein one of the calibrated illumination parameters is a light intensity of the illumination.

5. The method according to claim 1, wherein one of the calibrated illumination parameters is the respective direct or indirect character of the illumination of the plate element.

6. The method according to claim 1, wherein one of the calibrated illumination parameters is light intensity of the illumination.

7. A machine for processing plate elements comprising a successive series of operating stations through which the plate elements are to be conveyed, a conveyor configured and operable for conveying the plate elements through the stations, and gripping members on the conveyor for gripping the plate elements for fastening the plate elements temporarily to the introducer;

at least one illumination device configured and aimed for illuminating a location mark printed on a plate element fastened to an introducer by a fastening device;

at least one sensor configured and operable for measuring light intensity reflected by a surface of the plate element;

a control unit driving the introducer, the illumination device and the sensor wherein:

the illumination device is configured for generating different illuminations, the control unit is configured for driving the introducer to carry out a succession of back-and-forth movements with a plate element fastened by the fastening device;

driving the illumination device to select an illumination to be provided; and, determining a calibrated illumination based on a set of measurements made by the sensor.

8. The machine for processing plate elements according to claim 7, wherein the illumination device is aimed and configured for illuminating a location mark on the plate element directly or indirectly.

9. The machine for processing plate elements according to claim 8, wherein the illumination device comprises at least a fast source of light aimed and configured for directly illuminating the location mark and a second source of light aimed and configured for indirectly illuminating the location mark.

10. The machine for processing plate elements according to claim 8, wherein the illumination device is configured for illuminating the location mark at different intensities.

11. The machine for processing plate elements according to claim 8 wherein, the illumination device is configured for illuminating the location mark with different colors.

12. The machine for processing plate elements according to claim 11, wherein the illumination device comprises a plurality of sources of light.

13. The machine for processing plate elements according to claim 7, wherein the illumination device is incorporated into the sensor.

14. The machine for processing plate elements according to claim 7, wherein the illumination device is configured for illuminating the location mark at different intensities.

* * * * *